United States Patent [19]

Reichelt et al.

[11] Patent Number: 4,777,995

[45] Date of Patent: Oct. 18, 1988

[54] MAKING A HOLLOW OF ROTATIONAL SYMMETRY

[75] Inventors: Wolfgang Reichelt, Moers; Peter Voss-Spilker, Kempen; Karl-Heinz Haeusler, Korschenbroich; Horst Stinnertz, Willich, all of Fed. Rep. of Germany

[73] Assignee: Mannesmann AG, Duesseldorf, Fed. Rep. of Germany

[21] Appl. No.: 53,343

[22] Filed: May 22, 1987

[30] Foreign Application Priority Data

May 27, 1986 [DE] Fed. Rep. of Germany ..... 3617833

[51] Int. Cl.[4] ..... B22D 23/00

[52] U.S. Cl. ..... 164/46; 164/131; 164/344; 264/12; 425/7

[58] Field of Search ..... 164/46, 131, 344, 418, 164/459, 484, 441, 447; 264/5, 6, 8, 12; 425/6, 7, 8

[56] References Cited

U.S. PATENT DOCUMENTS 4,697,631 10/1987 Bungeroth et al. ..... 164/46

*Primary Examiner*—Nicholas P. Godici
*Assistant Examiner*—Richard K. Seidel
*Attorney, Agent, or Firm*—Ralf H. Siegemund

[57] ABSTRACT

Molten metal is sprayed onto a rotational mandrel which oscillates axially and an axial translatory extraction motion is superimposed for removing the built-up hollow from the mandrel.

14 Claims, 2 Drawing Sheets

MAKING A HOLLOW OF ROTATIONAL SYMMETRY

BACKGROUND OF THE INVENTION

The present invention relates to the making of hollows having rotational symmetry, particularly tubes, sleeves, or the like, and under utilization of molten atomized metal, either a pure metal or an alloy, by spraying the droplets of atomized metal onto a cylindrical capturing and shaping surface, while a relative motion in peripheral direction is introduced as between the spray and fog like state of the atomized metal, and the cyclindrical capturing surface.

A method of the type referred to above, particularly for making tubes, sleeves, or the like, is known, generally, and includes particularly the spraying of a fog of atomized molten metal onto a cylindrical capturing surface. A relative motion in peripheral direction, as far as the hollow to be made is concerned, is continuously provided. The capturing surface is specifically a round mandrel which is journalled at both end while rotating about its longitudinal axes. This way, then, a tube can be made by spraying the molten metal onto the rotating mandrel surface. Of course, the mandrel must be at least as long as the hollow to be made. In case the spraying beam is not as wide as the length of the hollow to be made, it is necessary to superimpose a longitudinal or axial motion upon the rotation of the mandrel. The length of the path for moving the mandrel in axial direction will then correspond to the length of the hollow to be made. On the other hand, if several spray heads are used, then the length of the longitudinal motion of the mandrel depends on the distance and spacing between the spray heads.

The hollow made by spraying metal droplets onto a mandrel serving as a capturing surface, can presently be made at a length of up to about 8 meters. Following the spray-on, i.e. upon completion of the tube making proper in that fashion, this tube has to be removed from a mandrel which, of course, has to be somewhat larger than 8 meters. This removal requires a rather extensive and expensive structure device. Moreover, another disadvantage of this method is simply to be seen in the fact that the mandrel has to be so long. Also, the mandrel would have to be heated prior to each spray step which, of course, requires further equipment and, in effect, wastes a large amount of energy.

Another drawback of the known method and equipment is that the rotation of the mandrel requires a high degree of accuracy, because one has to avoid that the mandrel looses its straightness. Finally, in spite of all these various aspects, there is an overall length limitation for making such a hollow because the longer the mandrel is, the higher will be the cost and complexity of the equipment involved in a disproportionate fashion.

DESCRIPTION OF THE INVENTION

It is an object of the present invention to provide a new and improved method for making hollows through a depositing process of atomized metal which avoids the various drawbacks of the known methods and equipments outlined above.

In accordance with the preferred embodiment of the present invention, it is suggested that using as a starting point the basic concepts of the prior art method, but the sprayed-on metal is continuously released and taken off from the cylindrical capturing surface. The invention is based on the discovery that it is possible to make hollows of, for practical purposes, unlimited length, and in an economic fashion, if one can modify the known method such that the discontinuous process is, so to speak, converted into a continuous or quasi-continuous one. Continuous working, however, has been disregarded in the past because it was believed that continuously taking off the work piece from the shaping substrate would pose unsurmountable difficulties. Surprisingly now, it was found that a quasi-continuous release from the capturing surface obtains, if, in furtherance of the invention, an oscillation in axial direction is imparted upon the capturing surface which motion avoids adherence of the sprayed-on material and hollow to the capturing surface which remains, therefore, just that, a capturing and overall shaping surface.

Simultaneously, and superimposed upon this oscillation, is a transport or translatory movement in longitudinal direction. Basically, the extraction can be carried out continuously in the true sense, or quasi-continuously. In the continuous mode, a regular axial extraction motion is superimposed upon the axial oscillation of the capturing surface. Quasi-continuous extraction obtains, if the two directions of the oscillations are carried out with unequal energies, such that a residual, relative translatory motion in axial direction obtains, as between the capturing surface and the hollow being "shaken loose" by that oscillation. In another quasi-continuous mode, the hollow is built-up in portions, beginning with a start-up portion, and the oscillation plus translatory motion is provided to make room for building up the next portion etc.

The oscillation of the capturing surface, generally, does not interfer with the gradual built-up of the hollow by means of the spray method. This is particularly true in conjunction with the portion already made. In accordance with a discovery pursuant to the invention, this lack of interference obtains because the metal drops solidify during flight and on impacting against the capturing surface, they solidify at that moment completely. The thus deposited solidified material will have enough coherence, so that, in fact, it will readily separate from that capturing surface, owing to its oscillation. Based on that discovery, as described, different methods of realizing the inventive method can be proposed, and the equipment may be differently configured accordingly.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Proceeding now to the detailed description of the drawings, FIG. 1 illustrates a ladle 2 which contains molten metal which is either a pure metal or an alloy. This metal will be atomized by means of a nozzle 4 which is basically a tube with just an outlet end, and being fed by the content of the ladle 2. The actual atomization is the result of a set of gaseous nozzles 3, being, e.g. of annular construction and blowing a pressurized gas against the metal as it emergers from the nozzle 4, thereby atomizing the flow of molten metal. This results in a fanned-out flow 5 of droplets which can also be termed a flow of a metal fog.

Figure 1:
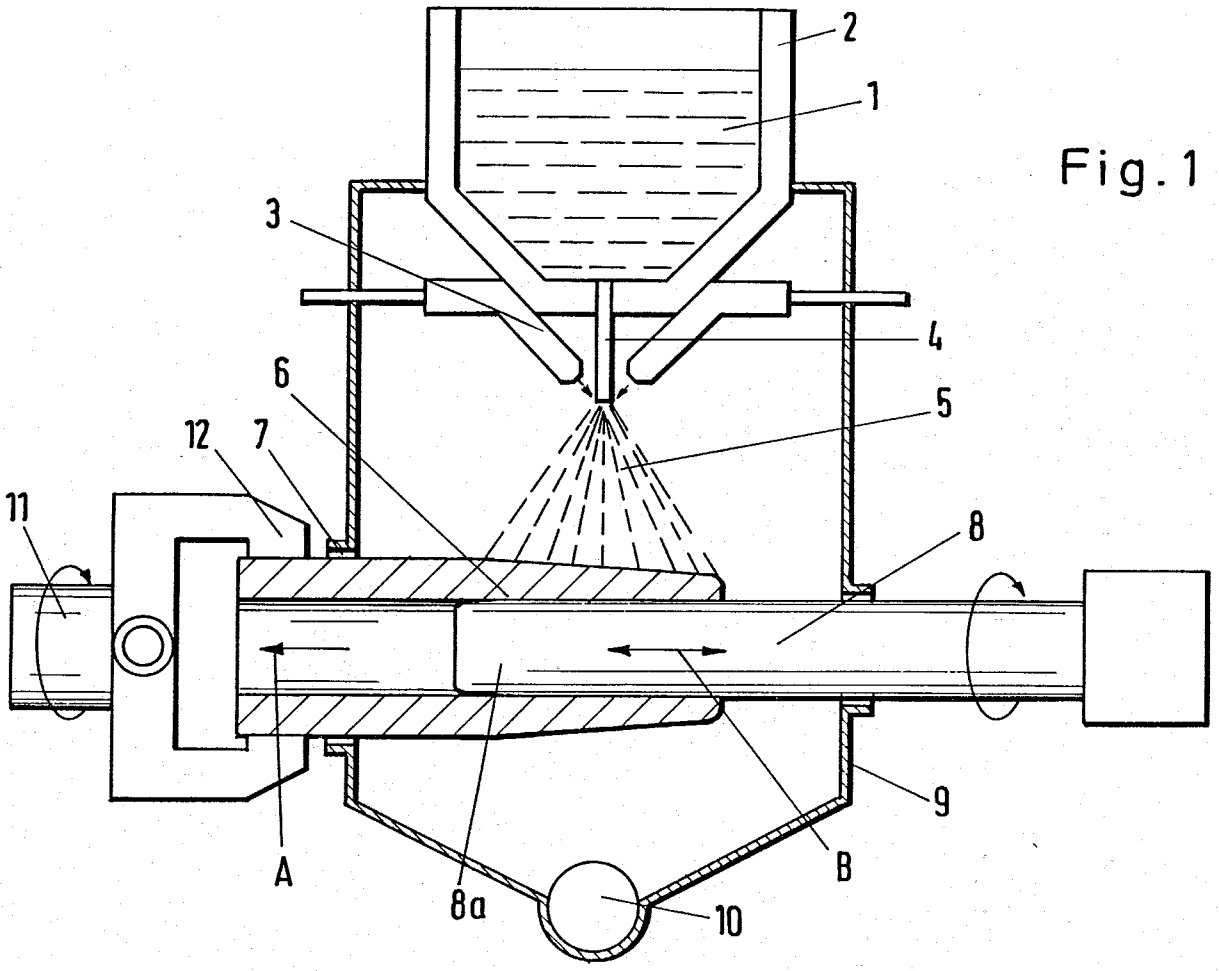
FIG. 1 is a somewhat schematic view and cross-section through equipment for practicing the inventive method in accordance with the preferred embodiment therof, thereby realizing a best mode of operation.

The steam of atomized molten metal reaches the capturing surface 8, being defined by the periphery of a mandrel 8*a*. The mandrel is made of steel or a ceramic. Specifically, the mandrel 8*a* is a horizontally positioned, round, cylindrical element, which rotates, as indicated by the curved arrow, and is being driven by a drive, that is not shown, at a constant speed. The mandrel is actually floatingly journalled to permit not only the rotation but an axial movement to be described more fully below.

In order to avoid oxidation of the atomized metal, it is of advantage to enclose all these various features and parts in a container 9, so that particularly the metal spraying and atomization process occurs within a protective gas atmosphere. The atomizing gas is preferably selected so as to form that atmosphere.

This spray of atomized metal 5 is basically of conical configuration and will impinge upon a portion of the mandrel 8 to built up a hollow 6. Owing to the rotation of the mandrel, the built-up occurs all around the mandrel's surface and its axis. The atomization process as produced by the gas which naturally is an interaction of a cold gas with molten metal, and therefore, a significant amount of heat is taken out of the molten metal's state right below nozzle 4. This cooling continues, of course, during the period of time from emergence of metal from the nozzle 4 until impingement upon the mandrel or the already built-up portions of the hollow 6. This means that on impact condensation occurs almost instantly and immediately a solid work piece is produced. The temperature of the capturing surface 8, and therefore the temperature of the material being built on and around that surface, is definitely below the melting point of the material. The spray zone 5 is such that the length of the mandrel inside container 9 is about two to three-fold the width of that zone 5.

In order to permit ready extraction of the mandrel 8 from the completed hollow 6, the mandrel is set into an oscillatory motion, as indicated by the double arrow B. The motion is coaxial with the axis of the mandrel. The device and structure for obtaining this motion is shown in the right of the figure and is illustrated only schematically. The oscillation continuously loosens the mandrel from the hollow 6. In addition, however, it is pointed out that the oscillation, as indicated by double arrow B, is not strictly symmetrical, but, for example, in the oscillation in the direction of arrow A, is carried out at a somewhat lower speed than in the opposite direction. The half waves of the oscillating period will not be the same, so that the unequal speed means do not cause the amplitude of the mandrel to be in both directions. Rather, the residual translatory motion in direction A results from a greater relative motion between mandrel and hollow during the reverse stroke while on a slower forward stroke (direction A), the hollow is more or less carried along by the mandrel. This step by step withdrawal establishes the quasi-continuous mode of withdrawal.

Instead of this asymmetry one could provide simply for a regular oscillation in a symmetrical fashion and superimpose a steady translatory motion upon the mandrel by the virtue of a superimposed longitudinal movement. This is actually shown, specifically, in FIG. 1, wherein the extraction device 11 rotates in unison with the mandrel, and it also oscillates just as the mandrel, but it holds, in addition, the end of the tube to be made by means of tongues 12, pulling the same in the direction of arrow A. In lieu of the tongues other roller extraction devices can be used.

The free end of the mandrel 8*a* is conically configured and owing to the combined oscillatory and translatory movement, the hollow 6 is gradually extracted from that end of the mandrel and passes through a gas seal 7 which prevents oxygen from entering the interior of chamber 9. The metal droplets-granules, not captured by the mandrel or by the portion of the hollow already completed, will drop to the bottom of the container 9 and will be taken out of the system, for example, for purposes or re-melting or the like, by means of a screw conveyor 10. The completed hollow or, better, the portion of the hollow which has been completed, increases, of course, with process time, and will be taken out of the system through a roller track or the like (not shown) configured to permit continuous rotation of the hollow 6.

It may be of advantage to begin the spray process by means of providing first a small hollow as a start-up piece, while the mandrel rotates but does not oscillate. Once this start-up piece has been built-up to the requisite wall thickness, it will be removed from the mandrel by turning on the oscillation device, and by transporting that start-up piece in the direction of arrow A out of the equipment, until the end of the start-up piece has cleared a sufficient space on the mandrel such that now the regular build-up of the hollow obtains. One may, switch off the oscillation drive, or throttling it, and provide the next section, and then one alternates between oscillation and no oscillation, or high and low amplitude oscillation with extraction occurring exclusively or primarily during the high amplitude oscillation phases.

The particular construction as illustrated pre-supposes that the mandrel and hollow rotates and moves, but instead one could have the mandrel circumscribed by one or several annular or rotating nozzles, causing the built-up of the hollow by spraying atomized molten metal from more or less all around the mandrel. However, longitudinal oscillations are still necessary, including a superimposed axial and longitudinal extraction motion for continuous or quasi-continuous extraction of the hollow.

Whenever either annular metallizing nozzles are used or nozzles rotating around the mandrel, it is not necessary for the mandrel to have a horizontal position. One can, for example, provide an inclination position whereby the more vertical the positon one obtains, the easier is the removal of the built-up hollow from the mandrel.

Figure 2:
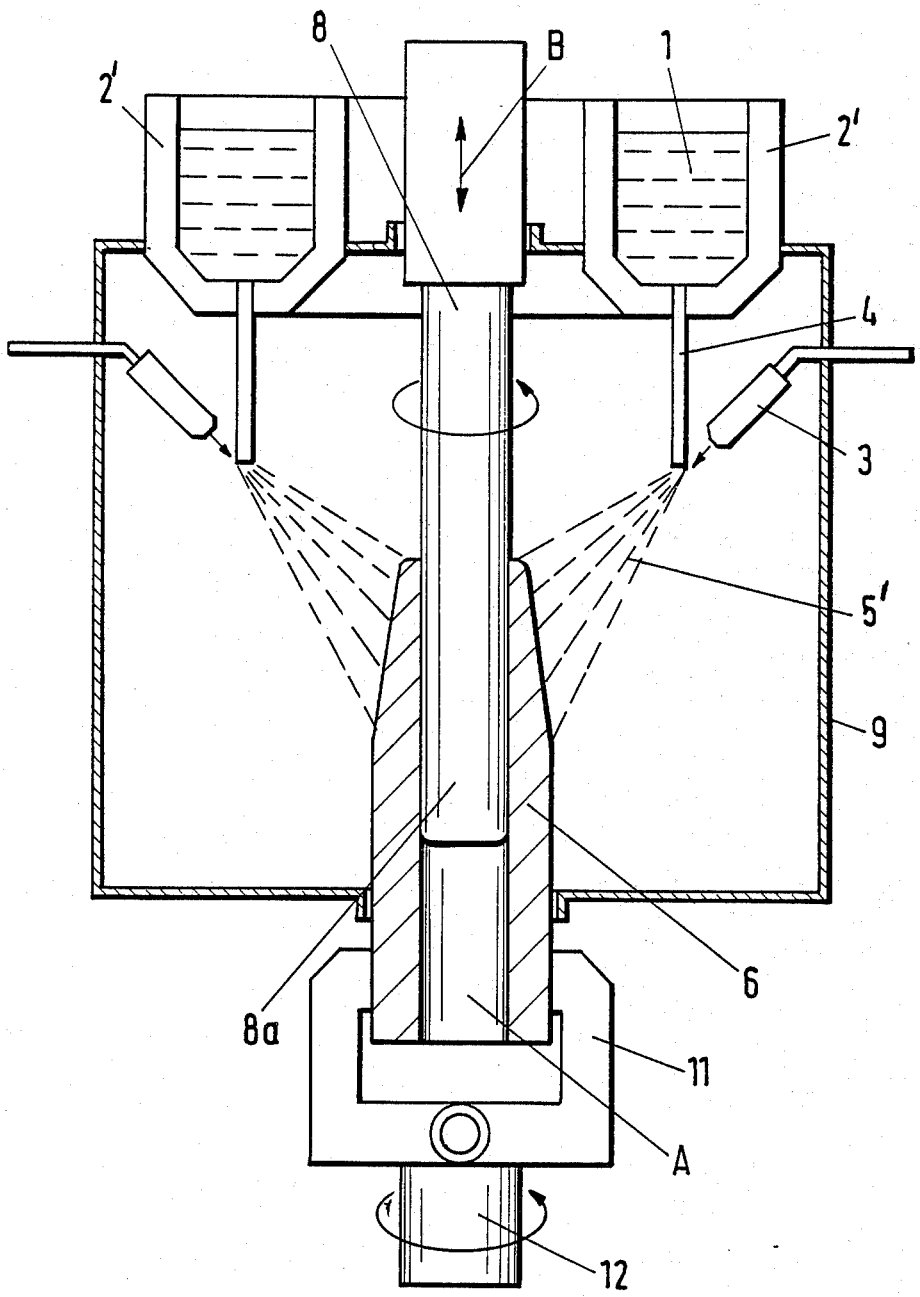
FIG. 2 illustrates a modification of the device and equipment shown in FIG. 1, likewise in a schematic fashion, and basically differing from FIG. 1 by a vertical, rather than a horizontal orientation of the capturing surface.

FIG. 2, basically, illustrates this vertical arrangement which otherwise is quite similar to the one shown in FIG. 1. The extracted tube here may, for example, be gradually veered into the horizontal for ease of further processing. The force of gravity is instrumental in stripping the hollow off the mandrel as the oscillating mandrel frees itself from the hollow.

FIG. 2 shows a ladle 2', circumscribing the mandrel and two (or more) nozzle tubes 4 are provided so that by means of gas jets several sprays 5' are provided in different directions. There still may be a rotation of the mandrel, but for many different directions or even an omnidirectional, centrally oriented spray flow, one may not need the rotation of the mandrel for obtaining the hollow build-up.

The invention is not limited to the embodiments described above, but all changes and modifications thereof, not constituting departures from the spirit and scope of the invention are intended to be included.

We claim:

1. Method for making hollows of rotational symmetry, comprising the steps of:
   providing a capturing surface of rotational symmetry;
   spraying atomized molten metal symmetrically towards said capturing surface for gradually building up the hollow to be made;
   imparting an oscillatory motion in an axial direction upon said capturing surface; and
   continuously or quasi-continuously extracting the hollow from the capturing surface by providing said oscillation at unequal speeds in opposite directions such that a relative translatory movement of the hollow in relation to the capturing surface is obtained.

2. Method as in claim 1, including the step of providing relative rotation between spraying and the capturing surface.

3. Apparatus for making hollows comprising:
   a mandrel;
   means for atomizing molten metal and spraying same towards the mandrel;
   means for causing the mandrel to oscillate longitudinally; and
   means for superimposing upon the longitudinal oscillation, a translatory motion between a gradually built-up hollow and the mandrel to thereby stepwise or continuously remove the hollow as built-up on the mandrel from the mandrel.

4. Apparatus as in claim 3, wherein at least a portion of the mandrel is made of a ceramic or steel.

5. Apparatus as in claim 3, wherein the mandrel has slightly conical ends.

6. Apparatus as in claim 3, the mandrel being horizontally disposed, there being means for rotating the mandrel.

7. Apparatus as in claim 3, the mandrel being vertically disposed.

8. Method for making hollows of rotational symmetry, comprising the steps of:
   providing a capturing surface of rotational symmetry;
   spraying atomized molten metal from different directions but symmetrically towards said capturing surface for gradually building up the hollow to be made; and
   continuously or quasi-continuously extracting the hollow from the capturing surface.

9. Method as in claim 8, wherein the capturing surface is definitely a mandrel, the included step further providing for relative rotation between the mandrel and spraying to vary in addition to the spraying from the different directions.

10. Method as in claim 8 and including the step of imparting an oscillatory motion in an axial direction upon said capturing surface.

11. Method as in claim 10, including the step of selecting said mandrel to have a length being between the two- and three-fold value of a width of a spray zone as provided by the atomizing step.

12. Method for making hollows of rotational symmetry, comprising the steps of:
   providing a longitudinal mandrel to establish a capturing surface or rotational symmetry, the mandrel being held on one end;
   spraying atomized molten metal from different directions but symmetrically towards said capturing surface for gradually building up the hollow to be made; and
   continuously or quasi-continuously extracting the hollow from the capturing surface.

13. Method as in claim 12 and including the step of imparting an oscillatory motion in an axial direction upon said capturing surface.

14. Method for making hollows of rotational symmetry, comprising the steps of:
   providing a capturing surface of rotational symmetry;
   spraying atomized molten metal symmetrically towards said capturing surface for gradually building up the hollow to be made;
   imparting an oscillatory motion in an axial direction upon said capturing surface; and
   continuously or quasi-continuously extracting the hollow from the capturing surface by superimposing an axial longitudinal motion upon the oscillation to obtain said extracting.

* * * * *